United States Patent [19]

Ege

[11] Patent Number: 5,064,350

[45] Date of Patent: Nov. 12, 1991

[54] PUMP STATION

[75] Inventor: Sigmund Ege, Oslo, Norway

[73] Assignee: Alcatel STK A/S, Oslo, Norway

[21] Appl. No.: 509,096

[22] Filed: Apr. 16, 1990

[30] Foreign Application Priority Data

May 16, 1989 [NO] Norway ..... 891946

[51] Int. Cl.[5] ..... F04B 39/00

[52] U.S. Cl. ..... 417/63; 92/156; 92/168; 417/370; 417/404

[58] Field of Search ..... 92/5, 156, 168; 417/63, 417/370, 404

[56] References Cited

U.S. PATENT DOCUMENTS

| | | | |
|---|---|---|---|
| 2,301,063 | 11/1942 | McConaghy | 417/370 |
| 3,310,230 | 3/1967 | Wirth | 92/168 X |
| 3,832,935 | 9/1974 | Syassen | 92/156 |
| 4,168,070 | 9/1979 | Tsuchihashi et al. . | |
| 4,834,618 | 5/1989 | Ege et al. . | |
| 4,858,937 | 8/1989 | Fairlie-Clark et al. | 417/46 |

FOREIGN PATENT DOCUMENTS

| | | | |
|---|---|---|---|
| 508840 | 10/1930 | Fed. Rep. of Germany . | |
| 3725221 | 2/1989 | Fed. Rep. of Germany . | |
| 1222668 | 6/1960 | France | 92/156 |
| 278550 | 10/1927 | United Kingdom . | |

*Primary Examiner*—Robert G. Nilson

*Attorney, Agent, or Firm*—Spencer & Frank

[57] ABSTRACT

The invention relates to an improved reciprocating pump providing oil for low pressure, self-contained oil-filled cables. it is particularly important to have a gas tight system in such a pumping plant since the oil in the storage tank (6) has to be kept under vacuum at all times to keep the oil in a gas-free condition. The air or gas driven oil pump (8) has two piston rod seals (9,10). The area between the two seals is provided with an inlet (11) and outlet opening (12) through which oil can be flushed from the high pressure side of the pump (8) to the top of a storage tank (6).

5 Claims, 1 Drawing Sheet

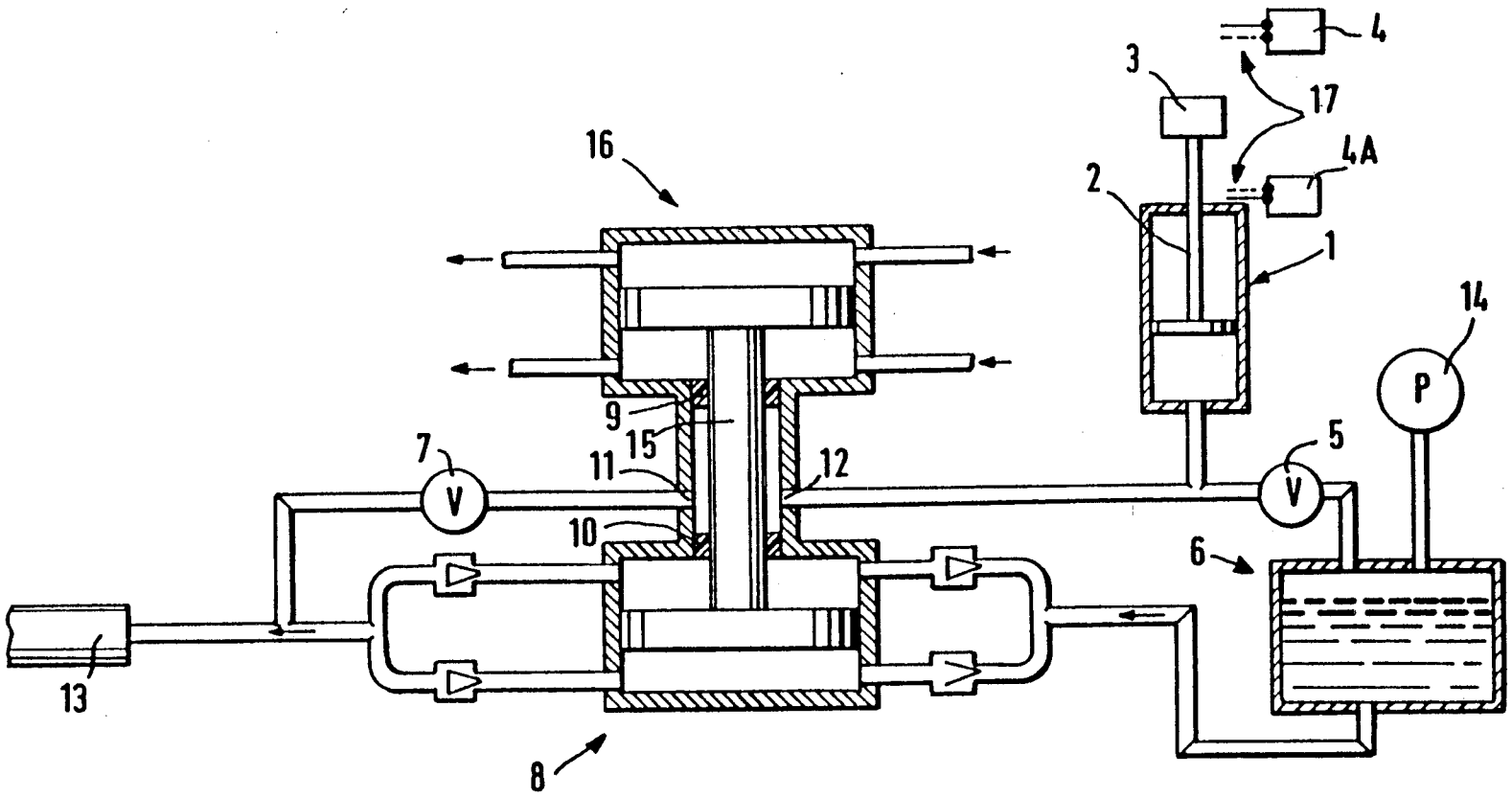
14
P
4
4A
17
1
5
V
6
3
2
12
16
9
15
11
10
8
7
V
13

PUMP STATION

BACKGROUND OF THE INVENTION

The present invention relates to an improved pump for a pumping plant for low pressure, self-contained oil-filled cables. It has been common practice to use so-called "canned", electrically driven pumps to pump oil from a storage tank and into the cable. It is particularly important to have a gas tight system in the pumping plant since the oil in the storage tank has to be kept under vacuum at all times to keep the oil in a gas-free condition.

Reciprocating pumps have, however, shown a number of advantages above an electrically driven screw — or gear pump, especially those where the pump is air driven, since maintaining a certain pressure on the cable system only means supplying the pump with air (or gas) at a certain pressure, and because the pump will only operate when oil is needed to maintain the desired pressure on the cable system.

At least one such air driven pump, namely one marketed under the trade name Haskel, has proven itself very useful for this purpose. Even though a pumping plant using such a pump is no longer "hermetically sealed", since piston rod seals have to be used, these seals have proven very effective in preventing air and moisture from entering the system.

To improve the conditions even further, it is known (Norw. Patent No. 160.318, S. Ege 13-2-1) to maintain a area between the two piston rod seals filled with oil from an oil cup, and it is even common to place another oil cup in the area outside the outer seal. The function of the latter cup is primarily that of providing better lubrication at the outer seal. The oil in these two cups will, however, after some time no longer be degasified, and there is a remote possibility that a minute amount of oil from the area in between the two seals may be drawn past the inner seal by the piston rod, and after a considerable amount of time cause a slight contamination of the oil in the system.

SUMMARY OF THE INVENTION

It is the object of this invention to eliminate the disadvantages of the piston rod pump as compared to a totally sealed pump. This is accomplished by creating a closed system also for the area in between the two seals, and providing means for keeping the oil in this system in a degasified condition.

In accordance with the invention, the pump is equipped with two openings to the area between the two seals, so that degasified oil from the pressure side of the pump itself may be flushed through the area between the seals and returned to the top of the storage tank. Any minute amount of air which may have been picked up by the oil in the outer cup and brought passed the outer seal as a result of the reciprocating action of the piston rod, will be removed when entering the storage tank.

How often this "seal-oil" system will need to be flushed will become apparent when testing the oil (which returns to the storage tank during flushing) for degree of degasification.

Above mentioned and other features and objects of the present invention will clearly appear from the following description of the invention taken in conjunction with the drawing.

BRIEF DESCRIPTION OF THE DRAWING

The FIGURE is a schematic illustration of a pump according to the invention.

DESCRIPTION OF THE PREFERRED EMBODIMENT

According to one embodiment of the invention, the "seal-oil" system is closed to the ambient by being connected to a cylinder 1 preferably placed in a vertical position with the piston rod 2 facing upwards, and with a weight 3 attached to the piston rod 2 of a size sufficient to overcome the friction in the cylinder so that even when the piston rod is on its way down, a pressure above the atmospheric pressure will be assured in the system. To avoid any oil between the two seals from becoming deteriorated with time, the valves 5 and 7 can be opened and 'fresh' oil can be flushed through the seal house.

Another embodiment of the invention incorporates limit switches 4 and 4A or other means of detecting the position of the piston rod so that a message can be transmitted to a manned control center (not shown) if the cylinder piston 2 should come close to one of its end positions, making an adjustment necessary. Such an adjustment will be done using the same procedure as for flushing, namely by first opening a valve 5 between this cylinder 1 and a storage tank 6 and then opening a valve 7 between a pump 8 and the cylinder 1, maintaining this valve open for a certain period of time, then closing it. By now closing the valve 5 towards the storage tank, the "seal-oil system" will now again be at a pressure above the atmospheric. Finally the valve 7 between the pump 8 and the cylinder 1 is cracked open to bring the piston in the desired position.

One additional feature of this system is that one will have a complete monitoring system for the piston rod seal of the pump. The piston rod seal arrangement consisting of an outer seal 9 and an inner seal 10 is interconnected with the valve 7 through an inlet 11 and with the cylinder 1 through an outlet 12. Should the inner seal 10 fail, for instance, this will bring the cylinder piston 2 to the top position, creating full pressure on the "seal-oil system". The pump will, however, still be operational, relying upon the outer seal 9 only. If the monitoring system used is one which can also give indication of how fast the piston is changing its position, e.g. by using additional position detectors 17, it will be able to distinguish between an alarm due to an inner seal failure and an alarm caused by normal, long time, movement of the piston. While the pump is capable of operating with only the outer seal, preparation should, of course, be made to have the pump replaced or repaired as soon as it is practical.

If the outer seal 9 should fail, the piston 2 will move rapidly to the lower position. Again the pump may be operated for a considerable amount of time in this mode, but should, of course, eventually be repaired.

An oil filled power cable 13 is pressurized with oil provided by the pump 8. A vacuum is maintained in the storage tank 6 by means of a vacuum pump 14. The piston 15 of the oil pump 8 may be powered by a gas operated pump 16 the detail of which are not described here.

The above detailed description of embodiments of this invention must be taken as examples only and should not be considered as limitations on the scope of protection.

What is claimed:

1. In a reciprocating air or gas driven oil pump comprising a piston having a head and a rod, a first cylindrical body within which the piston head is movably disposed, a second cylindrical body connected to a central opening of the first cylindrical body and two piston rod seals coaxially mounted on respective opposite ends of the second cylindrical body through with the piston rod reciprocates, the improvement comprising an inlet opening and an outlet opening disposed on the second cylindrical body between the two piston rod seals, said inlet opening being connected, via a first valve to the high pressure side of the pump and said outlet opening being connected via a second valve to the top of a storage tank, kept under a vacuum, from which the pump is drawing oil.

2. A pump according to claim 1, further comprising a cylinder having a piston, a top end having an opening through which the piston rod of the cylinder extends and a bottom end, said outlet opening being in communication with the bottom end of the cylinder; and a weight placed on top of the piston rod of the cylinder, wherein the cylinder is placed in a vertical position with its piston rod facing upwards, the weight being heavy enough to overcome the friction in the cylinder so that a slight over pressure is maintained at all times.

3. A pump according to claim 2, wherein the piston rod of the cylinder is associated with switching means included in a monitoring system, for actuating an alarm system which will indicate that the piston rod of the cylinder is either in a near top or a near bottom position.

4. A pump according to claim 1, further comprising a cylinder having a piston rod reciprocating therein, a top end having an opening through which the piston rod of the cylinder extends and a bottom end, said outlet opening being in communication with the bottom end of said cylinder, wherein the piston rod of the cylinder is associated with a switching means included in a monitoring system, for actuating an alarm system which will indicate that the piston rod of the cylinder is either in a near top or a near bottom position.

5. A pump according to claim 4, wherein the switching means includes additional switch means which is capable of indicating at which speed the piston rod of the cylinder reaches one of its top or bottom positions.

* * * * *